US009937631B2

(12) United States Patent
Wong

(10) Patent No.: US 9,937,631 B2
(45) Date of Patent: Apr. 10, 2018

(54) FOOD CUTTING APPARATUS

(71) Applicant: Yan Kwong Wong, Kowloon (HK)

(72) Inventor: Yan Kwong Wong, Kowloon (HK)

( * ) Notice: Subject to any disclaimer, the term of this patent is extended or adjusted under 35 U.S.C. 154(b) by 153 days.

(21) Appl. No.: 14/766,803

(22) PCT Filed: Feb. 13, 2014

(86) PCT No.: PCT/IB2014/058953
§ 371 (c)(1),
(2) Date: Aug. 10, 2015

(87) PCT Pub. No.: WO2014/132161
PCT Pub. Date: Sep. 4, 2014

(65) Prior Publication Data

US 2015/0375414 A1 Dec. 31, 2015

(30) Foreign Application Priority Data

Feb. 28, 2013 (HK) ..... 13102574.5

(51) Int. Cl.
*B26D 3/28* (2006.01)

(52) U.S. Cl.
CPC ..... *B26D 3/283* (2013.01); *B26D 2003/286* (2013.01); *B26D 2003/288* (2013.01)

(58) Field of Classification Search
CPC ..... B26D 2003/286; B26D 2003/288; B26D 3/283; Y10T 83/9493; Y10T 83/9495; Y10T 83/9498
See application file for complete search history.

(56) References Cited

U.S. PATENT DOCUMENTS

| | | | | |
|---|---|---|---|---|
| 2,032,562 | A * | 3/1936 | Burns | A47J 17/04 30/113.3 |
| 4,570,519 | A * | 2/1986 | Motosko, II | B26B 5/007 30/283 |
| 5,613,431 | A * | 3/1997 | Tateno | A47J 17/02 30/114 |
| 2004/0231482 | A1* | 11/2004 | Boilen | B26D 3/283 83/425.3 |
| 2007/0089577 | A1 | 4/2007 | Wong | |
| 2011/0154998 | A1* | 6/2011 | Wong | B26D 3/283 99/537 |

FOREIGN PATENT DOCUMENTS

| | | | |
|---|---|---|---|
| CN | 2915420 | Y | 6/2007 |
| CN | 201625994 | U | 11/2010 |
| CN | 102309261 | A | 1/2012 |
| EP | 1918078 | A2 * | 5/2008 |
| GB | 2375950 | A | 4/2002 |

* cited by examiner

*Primary Examiner* — Stephen Choi
(74) *Attorney, Agent, or Firm* — Miskin & Tsui-Yip LLP; Gloria Tsui-Yip

(57) ABSTRACT

A food apparatus comprises a frame (1), a main body (5) and a blade body (25). The main body is set on the frame. The food cutting apparatus further comprises a lifting device (21) and a locking structure (20). The lifting device pushes the main body to move vertically. The blade body is fixed on the frame by the locking structure.

12 Claims, 12 Drawing Sheets

FOOD CUTTING APPARATUS

FIELD OF THE INVENTION

The present invention relates to an apparatus for cutting food which can be used for cutting fruits and vegetables.

BACKGROUND OF THE INVENTION

Fruits and vegetables, such as potatoes and pumpkins, are the typical food consumed by our societies daily. Generally, people like to cook these fruits or vegetables after slicing or shredding process. However, it requires a certain level of cutting skills and the related skill of art without of which one may hurt his fingers accidentally. Moreover, the user may also be hurt by touching the cutting blade accidently due to the user's carelessness. Nowadays, a variety of food cutting apparatuses are welcomed by many families, especially the young families.

Currently, there is a type of food cutting apparatus having a base and a cutting device mounted on the base. There are some concave regions under the side edge of the base for putting empty bowls or other types of containers, such that the fruits or vegetables after being cut can directly drop inside the containers under the base. However, the space between those concave regions may not suit for every container, which causes a lot of inconvenience in practical use.

SUMMARY OF THE INVENTION

The problem to be solved in the present invention is to provide a food cutting apparatus which is adapted for mounting on different types or sizes of containers, the apparatus can be more convenient to use. Another problem to be solved in the present invention is to provide a food cutting apparatus which is safe to use and easy to clean.

The present invention provides a food cutting apparatus comprising a base; a body mounted to the base and a cutting device.

Typically, the apparatus further comprise a lifting means for moving the body vertically.

Typically, the apparatus further comprises a locking device adapted for removably mounting the cutting device to the base.

Typically, the lifting means comprises a driving member being arranged between opposing walls of the base and a body mounting member adapted for mounting the driving member to the body, the driving member comprises a thread end, the driving member further comprises at least one inclined elongated hole.

Typically, the body mounting member comprises at least one convex structure, the convex structure is adapted to be received by the inclined elongated hole of the driving member.

Typically, the lifting means further comprises a mounting structure adapted for receiving the driving member, a hole adapted for receiving the convex structure of the body mounting member is arranged on a side of the mounting structure.

Typically, the locking device comprises an elastic member adapted for dismounting the cutting device from the base, a locking structure adapted for mounting the cutting device to the base and a track adapted for restricting the cutting device to be moved along the inner wall of the base.

Typically, the locking structure comprises a trapezoidal structure, the trapezoidal structure comprises an inclined surface which is shaped to correspond with an inclined surface of a projection projected from a side of the cutting device.

Typically, a spacing between the body and the cutting device being defined as a food escape region, the base comprises two opposing first supporting members and two opposing second support members, at least one concave region is arranged on a bottom side of the first supporting member, the bottom side of the first supporting member comprises a curved portion.

Typically, two ends of a bottom side of a first supporting member of the base are of curved structures, at least one concave region is arranged on the curved structure of the first supporting member.

Typically, the remaining region of the bottom side of the first supporting member other than the concave region is of curved shape, a pair of supporting structures is arranged under a second supporting member.

Typically, one pair of the supporting structures adapted for being received under the body are pivotally mounted to a second supporting member.

Typically, the side edges of the supporting structures are of the positions within the bottom edges of the first supporting member, one pair of the supporting structures is adapted to be rotatably mounted to a second supporting member, one pair of the supporting structures has flat bottom bases, another pair of the supporting structures has curved bottom bases.

Typically, one pair of the supporting structures comprises at least one concave region positioned on the side edges of the supporting structures.

Typically, the apparatus comprises a lifting means adapted for adjusting the spacing between the body and the cutting device through vertical movement of the body, the lifting means comprises a mounting structure adapted for mounting the body, a driving member adapted for receiving the mounting structure, a knob adapted to be screwed with the driving member, a positioning means for restricting the movement of the driving member is arranged on the mounting structure and the driving member.

Compared with the food cutting apparatus of the existing technology, the food cutting apparatus of the present invention designs its side edge under the base as arc-shaped, which makes the base more practical; so that containers of different sizes and shapes can be cooperated well with the food cutting apparatus to achieve the effect of ease of use.

BRIEF DESCRIPTION OF THE DRAWINGS

This and other objects, features and advantages of the invention will become apparent upon reading of the following detailed descriptions and drawings, in which.

Numbering of the Main Components

| | |
|---|---|
| base | 1 |
| plate | 10 |
| second supporting members | 101 |
| first supporting members | 102 |
| Spacing | 103 |
| concave region | 104, 42 |
| supporting structure | 16, 40 |
| locking device | 20 |
| button | 201 |
| locking member | 202 |
| elastic member | 204 |
| locking structure | 205 |
| lifting means | 21 |
| mounting structure | 22 |
| driving member | 23 |
| knob | 24 |
| cutting device | 25 |
| rolling cutter | 30 |
| handle | 31 |
| knife holder | 32 |
| blade | 33 |
| protecting cover | 34 |
| side edge | 41 |
| body | 5 |

DESCRIPTION OF THE PREFERRED EMBODIMENTS

Figure 1:
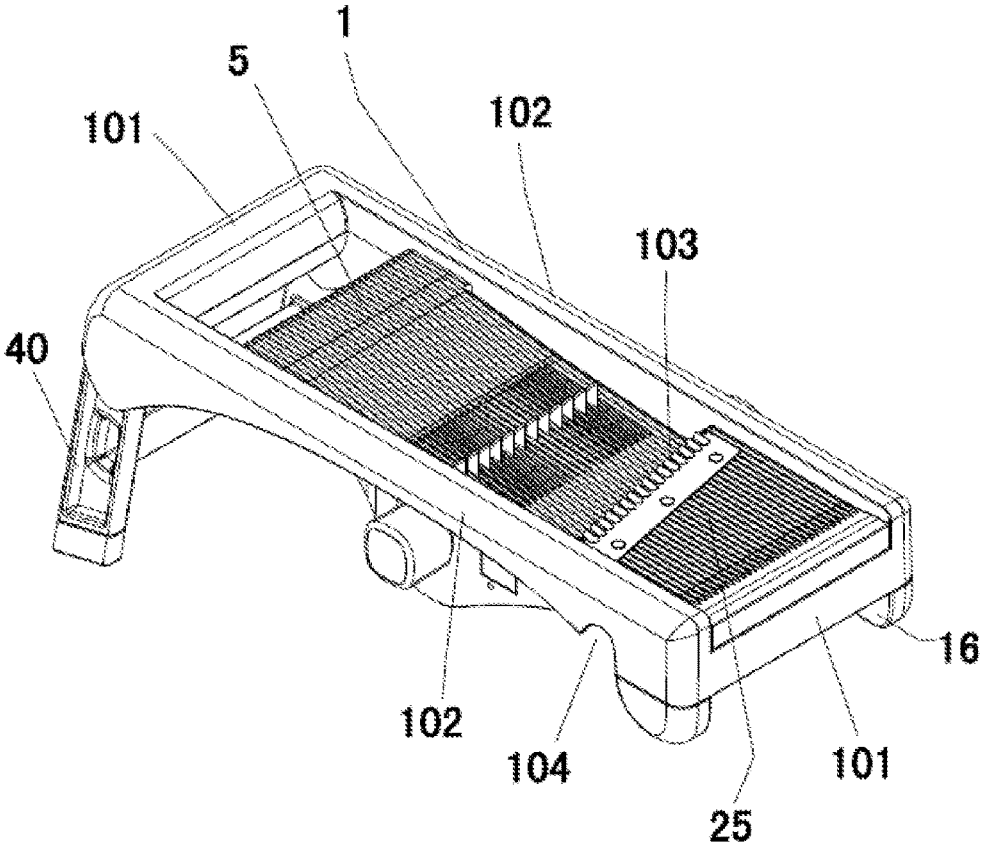
FIG. 1 is a perspective view of the food cutting apparatus of a first embodiment of the present invention.

Referring to FIG. 1, the food cutting apparatus of an embodiment of the present invention comprises a base 1, a body 5 mounted to the base 1 and a cutting device 25. A spacing 103 being arranged between the body 5 and the cutting device 25 is defined as a food escape region.

The user can hold fruits or vegetables to slide along the body 5 and then cut by the cutting device 25. The fruits or vegetables after being cut or the elongated substance can be fallen on to the bottom part of the base through the spacing 103. A bucket or bowl or other type of container can be arranged under the base 1 such that the fruits or vegetables after being cut or the elongated substance can stored inside the container.

The base 1 comprises two opposing first supporting members 102 and two opposing second supporting members 101, the first supporting member 102 and the second supporting member 101 in turn connected end to end, forming a rectangular frame substantially.

Preferably, the base 1 comprises opposing first and second supporting structures arranged under the base 1. The end portions of the first and second supporting structures are made of plastic for the purpose of prevention of slipping during operation. Further, curved-shaped end portions of the first and second supporting structures can be constructed in order to be used on different surfaces. Furthermore, the first and second supporting structures are pivotally mounted to the end portion of the base 1 and can be received under the base 1 such that it is convenient to perform cutting on top of the aperture of the container.

In another embodiment, the first supporting member 102 comprises at least one curved portion arranged on the bottom edge portion of the first supporting member 102. Alternatively, the remaining portion can be in form of a flat shaped structure. When the bottom edge portion of the first supporting member is of flat shaped structure, there will have a spacing between the concave region 104 and curved portion.

The concave region 104 can rest on an edge of the container, the curved portion of the bottom edge portion of the base 102 can then be supported by an opposite edge of the container. Due to the curved shaped structure of the bottom edge portion of the first supporting member 102, the apparatus of the present invention is adapted to put onto a variety of sizes and shapes of containers. When a side edge of the container is received inside the concave region 104, the curved region of the bottom edge portion can be supported by another side edge of the container. As such, the apparatus can be mounted on the container firmly such that the apparatus can be used more conveniently.

Further, in another embodiment, two ends of the second supporting member are preferably of curved-shaped. Each curved-shaped portion of the two ends of the second supporting member comprises at least one concave region. As such, if two ends of the concave region 104 and the edge of the container can be received with each other, the another edge of the container and the another end of the curved bottom edge of the first supporting member 102 are supported with each others.

Figure 2:
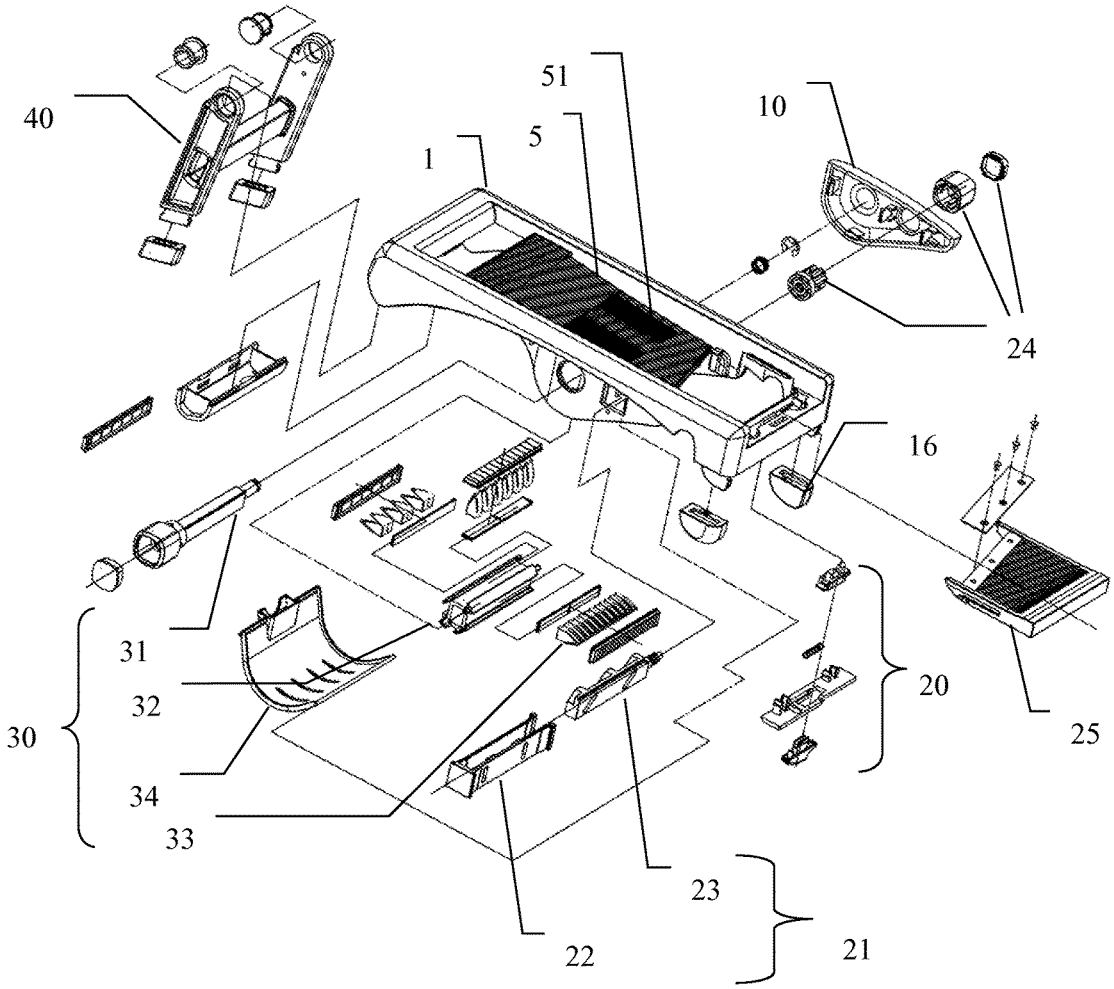
FIG. 2 is an exploded view of FIG. 1.

Referring to FIG. 2, in the embodiment, the food cutting apparatus further comprises a locking device 20, the cutting device 25 is mounted to the base 1 through the locking device 20. It is possible to apply different kinds or shapes of the cutting device 25 to the food cutting apparatus, such as flat cutting tools or wave-shaped cutting tools, in order to fulfil the user's requirement of cutting a variety of fruits or vegetables into different shapes and sizes. Furthermore, a blade can be mounted to the cutting device 25 through a mounting structure (such as screw) so as to form a cutting device having a mountable blade which is adapted for cutting fruits and vegetable into a variety of shapes and sizes by using a single cutting device 25 mountable to different kinds or types of blades only.

Typically, the locking device 20 can be constructed as a toggle button. Preferably, the locking device is adapted to be released by moving towards a first position. The cutting device 25 can be removed from the base 1 and is adapted to be mounted or locked to the base 1 by moving the locking device towards a second position.

Figure 3:
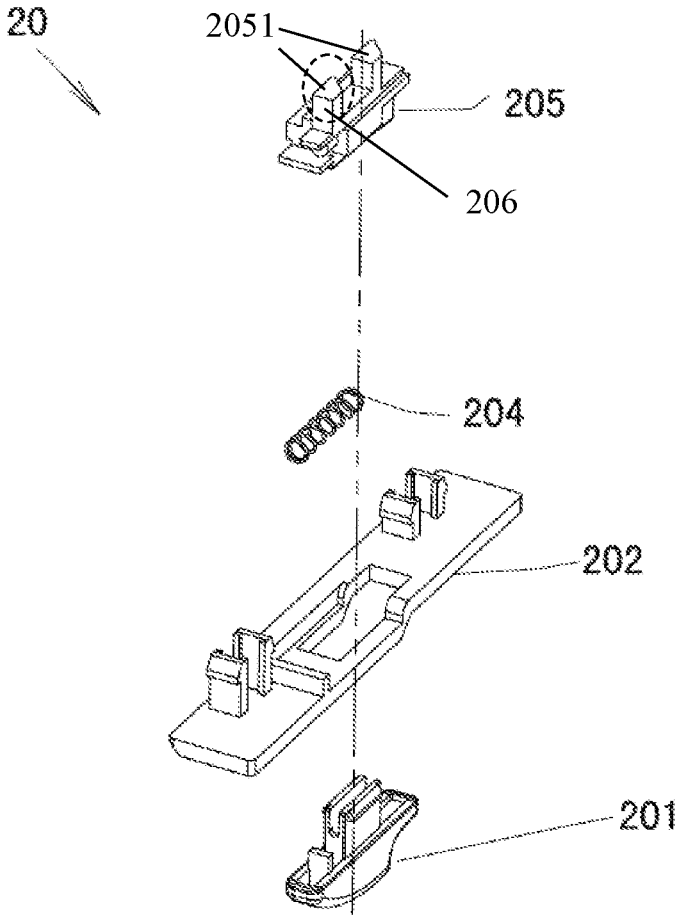
FIG. 3 is a partial enlarged view of FIG. 2.

In the embodiment, the locking device 20 can comprises an elastic member, the elastic member is adapted to eject the cutting device 25 out from the base 1 after releasing the cutting device 25 through the locking device 20. It is very convenient for the user to mount and remove the cutting device 25 from the base 1. Referring to FIG. 3, in the embodiment, the locking device 20 comprises a button 201, a locking member 202, an elastic member 204 and a locking structure 205. The button 201 is connected to the locking structure 205 through the locking member 202. The elastic member 204 is arranged between the locking structure 205 and the locking member 202. Preferably, the elastic member 204 is horizontally arranged and can also be compressed horizontally in order to supply elastic force. While the cutting device 25 is under installation, the elastic member 204 forces the locking structure 205 to embed into the cutting device 25 for allowing the cutting device 25 in a fixed position. When the cutting device 25 is to be taken out from the base, the button 201 can be moved to a direction that can compress the elastic member 204 in order to force the locking structure 205 to move out from the cutting device 25. Meanwhile, the locking structure 205 supplies force against the cutting device 25 and the cutting device 25 will then be ejected out from the base 1.

In a second embodiment and referring to FIG. 8 to FIG. 12, the locking device 20 in the second embodiment comprises an elastic member 61 which is made of plastic. The elastic member 61 can move the locking structure 205 to a left or right directions through the button 201 such that the cutting device 25 can be locked up to the base 1. Particularly, the locking structure 205 can be constructed as a trapezoid-shaped structure 206 (see also FIG. 3). An inclined surface 2051 of the trapezoid-shaped locking structure 205 can be received with a trapezoid-shaped projection 251 extended from a surface of the cutting device 25. When the cutting device 25 is pushed towards the body 5 by the user, the elastic member 61 will then be under pressure and compressed. Instantaneously, an inclined surface 2511 of the trapezoid-shaped projection 251 of the cutting device 25 will also be moved which allows the locking structure 205 be moved along the inclined surface 2511 of the trapezoid-shaped projection 251. The above movement along the surface of the locking structure 205 drives the button 201 to move horizontally. When the trapezoid-shaped projection 251 moves to the edge of the inclined surface 2051 of the trapezoid-shaped locking structure 205, the trapezoid-shaped projection 251 will then be received by another surface of the locking structure 205 such that the cutting device 25 will be in a locking position. Furthermore, when the user moves the button 201 to an alternative direction, the trapezoid-shaped projection of the cutting device 25 will then be moved from a surface of the locking structure 205 to the inclined surface 2051 of the locking structure 205. Accordingly, the elastic member 61 will be released from the compression state and the cutting device 25 will be moved out from the base 1. Preferably, in order to solve the safety problem that the user is easy to be hurt during installation and dismounting process of the cutting device 25 from the apparatus of the existing technology, the present invention provides a sliding track 207 being arranged on the inner walls of the base 1 adapted for restricting the cutting device 25 be moved along the sliding track 207 only and disallowing the cutting device 25 be ejected out from the apparatus.

In the embodiments, the body 5 comprises a rolling cutter 30 mounted under the body 5. The body 5 further comprises a plurality of platforms 51 adapted for allowing the blades of the rolling cutter 30 be projected above the body 5 while rotating. When the rolling cutter 30 is rotated and in an exposed position above the body 5, it can help to cut fruits and vegetables on the body 5 and make the cutting process smoothly.

In particular, a rolling cutter 30 comprises a handle 31, knife holder 32 covered on the handle 31 and a plurality of blades 33 mounted on the knife holder 32. The handle 31 can be mounted on the base 1 through the plate 10 located under the base 1. By rotating the handle 31, the blades 33 of the rolling cutter 30 will partly be projected from the body 5 or received under the body 5. Preferably, the rolling cutter 30 comprises a protecting cover 34 being mounted on the knife holder 32 adapted for protecting the user from being cut by the blades 33 projected under the body 5.

In a second embodiment of the present invention and referring FIG. 8 to FIG. 12, the food cutting apparatus comprises a lifting means 21 adapted for driving the body 5 to be moved vertically respective to the base 1. Preferably, the lifting means 21 comprises a knob 24 adapted to be rotated in order to adjust the spacing between the body 5 and the cutting device 25. Further, the lifting means 21 can promote the body 5 moving up and down. The lifting means 21 comprises a mounting structure 22 being mounted to the body 5, a driving member 23 being received by the mounting structure 22 and a knob 24 being screwed with the driving member 23. A positioning means for restricting the scope of movement of the driving member 23 is arranged on the mounting structure 22 and the body mounting member 26. Preferably, the knob 24 can be arranged on the plate 10 or other proper position on the base 1. The driving member 23 can be moved horizontally relative to the mounting structure 22 by operating the knob 24 and drives the movement of the body 5 so as to adjust the spacing between the body 5 and the cutting device 25, by means of which the cutting thickness of fruits and vegetables can be controlled. The positioning means allows the cutting device 25 staying at a positon on the body 5 and prevents the driving member 23 from moving too much. For the reason that the body 5 is of the position below the cutting device 25, it allows the fruits and vegetables which is slidingly positioned on the body 5 can be cut smoothly. Typically, the positioning means can comprise elongated holes 222, and a convex structure 261 which are arranged on the mounting structure 22 and the body mounting member 26 respectively. By rotating the knob 24 to the extent that the convex structure 261 reaches the end of the elongated hole 222, the driving member 23 will then be unable to move such that the body 5 is prevented from moving too much and it ensures that the body 5 is positioned above the cutting device 25.

Preferably, one end portion of the driving member 23 can comprises a threaded end member 233. The horizontal movement of the driving member 23 is driven by the movement of threaded end member 233 through the rotation of the knob 24. The body mounting member 26 is removably mounted to the body 5 and the driving member 23. The driving member 23 can comprises at least one inclined elongated hole 232 arranged on a side of the driving member 23. Particularly, the at least one inclined elongated hole 232 can be adapted for receiving at least one convex structure 261 and allowing the body mounting member 26 to be moved along the at least one inclined elongated hole 232 of the driving member 23 such that the body 5 can perform lifting movement. More particularly, the driving member 23 is arranged inside the mounting structure 22. The mounting structure 22 comprises an elongated hole 222 being adapted for receiving the at least one convex structure 261 of the body mounting member 26 arranged vertically on a side of the mounting structure 22. More particularly, at least one convex structure 261 is restricted to be moved along the elongated hole 222 of the mounting structure 22 and the body 5 is therefore prevented from removing from the base 1.

In another embodiment, -a two pairs of supporting structures 16 & 40 are mounted to the bottom portion of each second supporting member 101. The two pairs of supporting structures 16 & 40 are adapted for supporting the base 1 to be placed on a desktop, or other similar object.

In another embodiment, one pair of the supporting structures 40 is adapted to be rotatably mounted to one second supporting member 101 and received below the body 5. The implementation of how the pair of supporting structures 40 be received below the body 5 is shown in FIG. 4.

Figure 10:
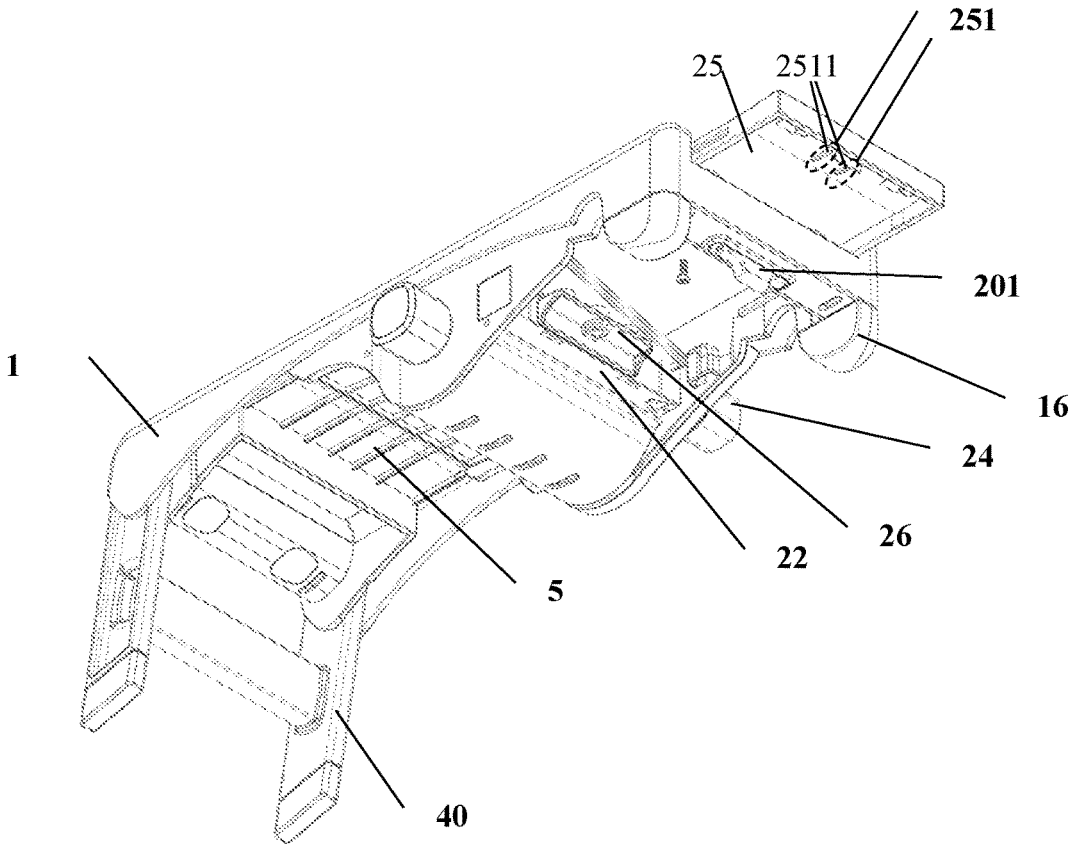
FIG. 10 is an alternative perspective view of FIG. 1.
Figure 11:
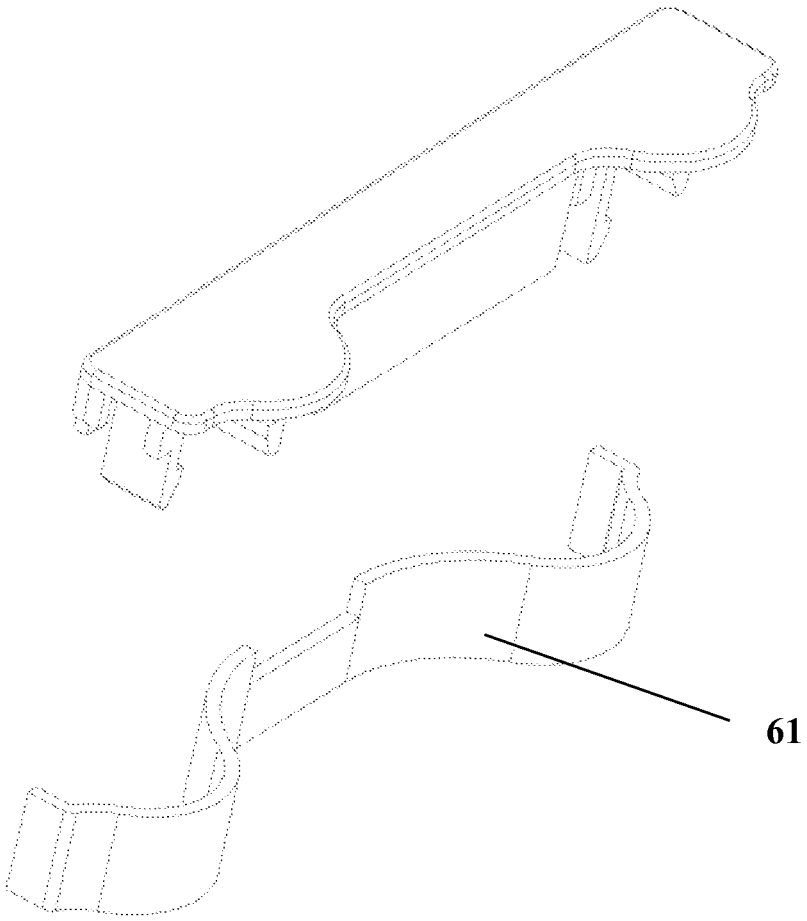
FIG. 11 is a perspective view of an elastic member of a locking device of the second embodiment of the present invention.
Figure 12:
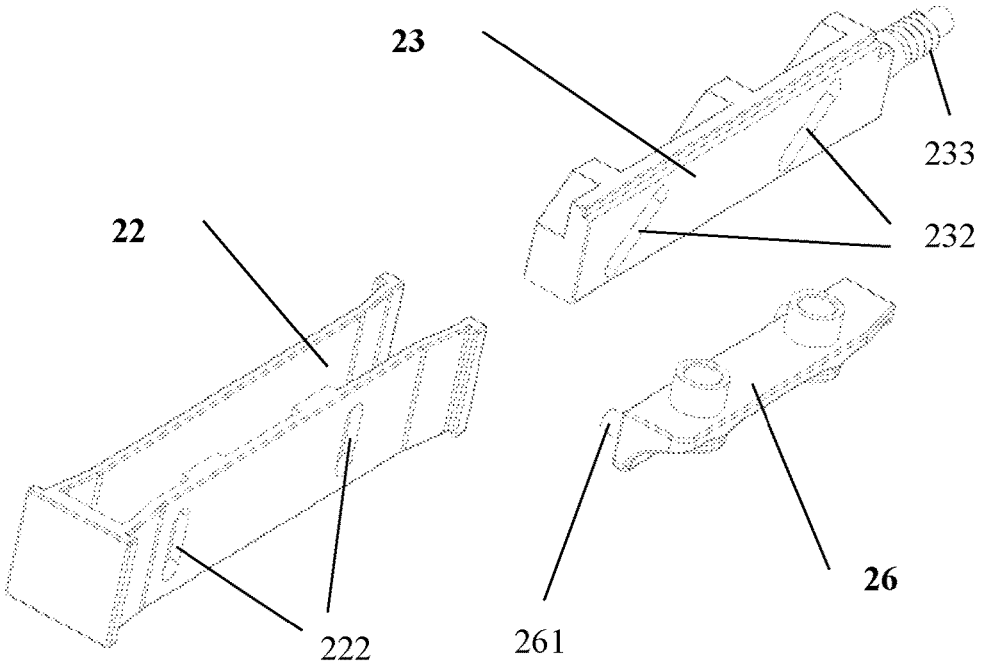
FIG. 12 is a perspective view of a lifting means of the second embodiment of the present invention.

Referring to FIG. 1 and FIG. 10, when the first pair of supporting structure 40 is in an open position, the first pair of supporting structure 40 and the second pair of supporting structure 16 can form structural parts for supporting the food cutting apparatus to place on a desktop or other type of platform. Further, a container for carrying the fruits and vegetables being cut by the apparatus can arrange below the base 1 and between the first pair of supporting structure 40 and the second pair of supporting structure 16.

Preferably, the first pair of supporting structure 40 comprises a flat bottom portion. The second pair of supporting structures 16 comprises a curved bottom portion. The design of curved-shaped structure of the bottom portion of the second pair of supporting structures allows a greater tolerance on the flatness of planar surface of a desktop such that even if the desktop surface is not of a perfect planar surface, the second pair of supporting structure 16 having the curved bottom portion is therefore adapted to be positioned on a surface firmly and is convenient to be used by the user.

Figure 4:
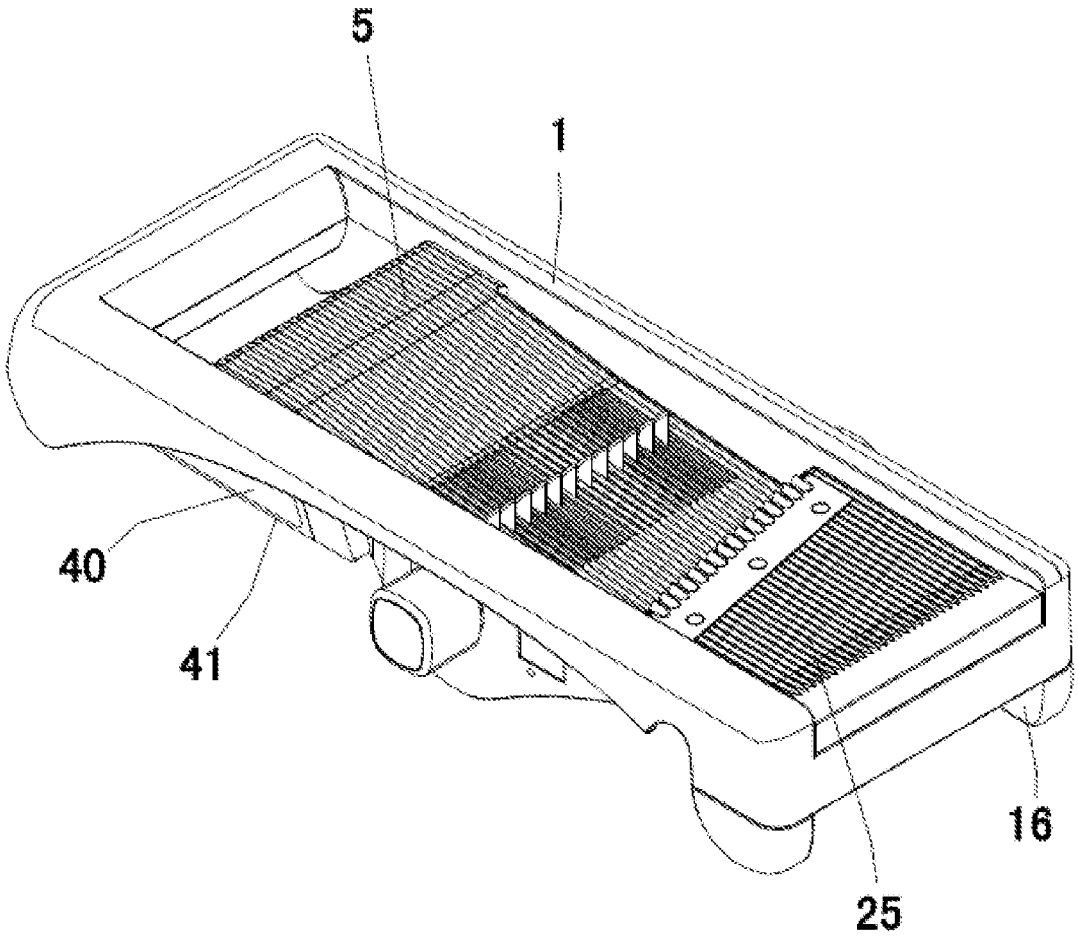
FIG. 4 is an alternative perspective view of FIG. 1.
Figure 9:
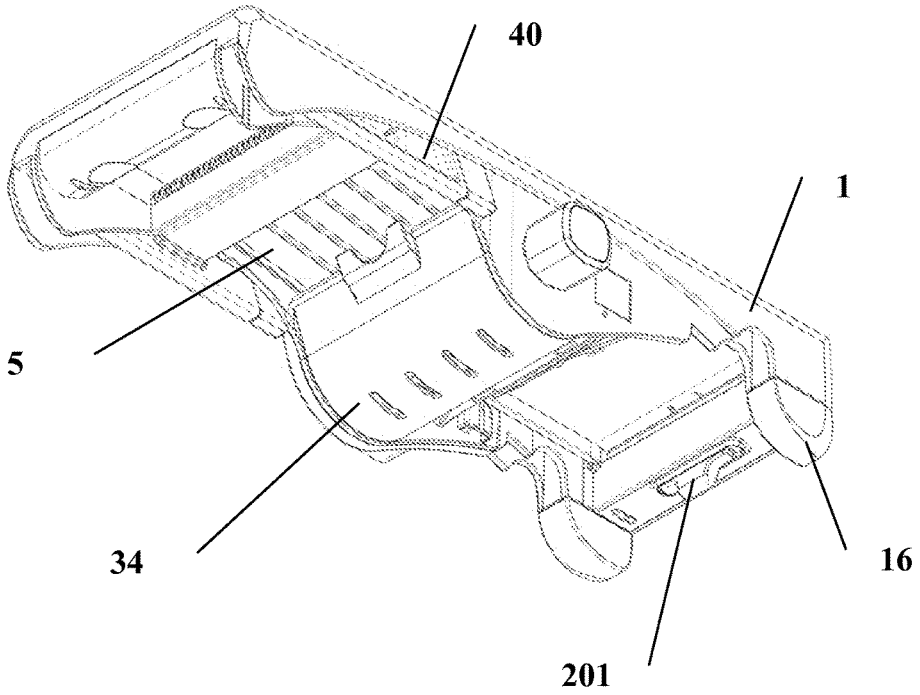
FIG. 9 is an alternative perspective view of FIG. 4.

Referring to the FIG. 4 and FIG. 9, when the first pair of supporting structure 40 is received under the body 5, the side edge 41 of the first pair of supporting structure 40 is then projected from the bottom edge of the first supporting member 102 of the base 1. In some embodiments, it is preferably to arrange the size of the first pair of supporting structure 40 or adjust the size of the base 1 in order to disallow the side edge 41 of the first pair of supporting structure 40 to be projected from the bottom edge of the first supporting member 102 when the first pair of supporting structure 40 to be received under the body 5. As such, the bottom edge of the first supporting member 102 can therefore be a part of the apparatus which is in contact with the container.

Figure 5:
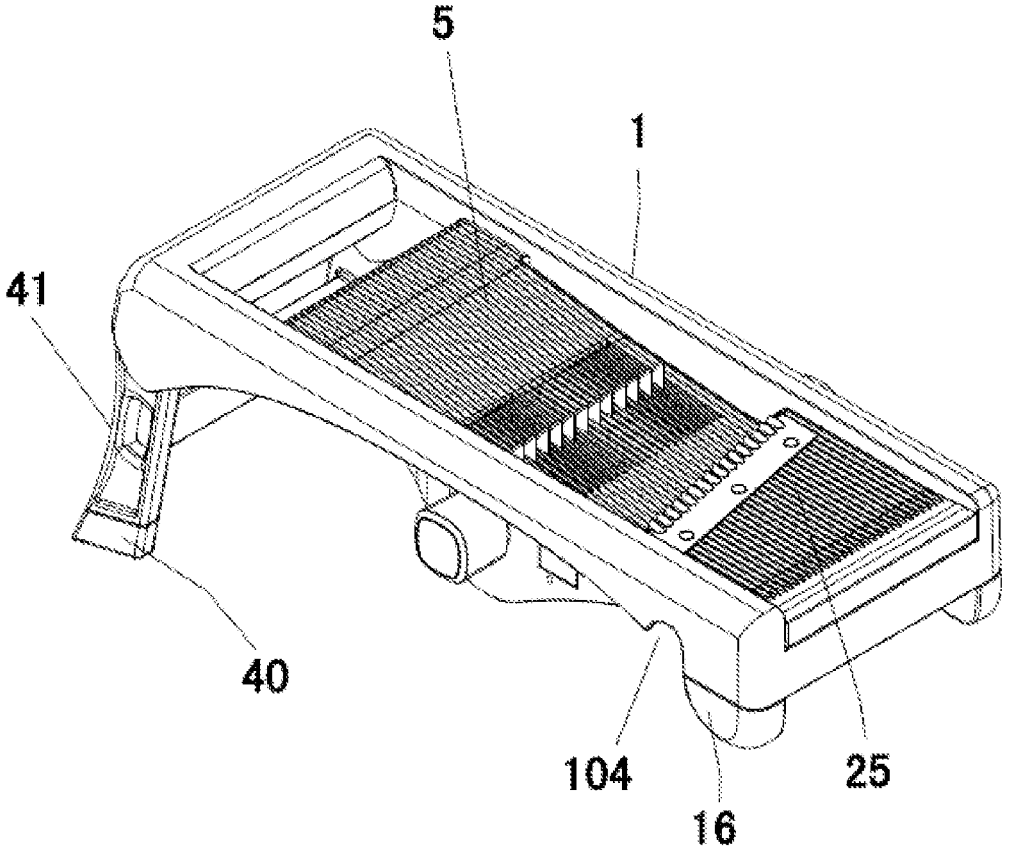
FIG. 5 is a perspective view of other embodiment of the present invention.
Figure 6:
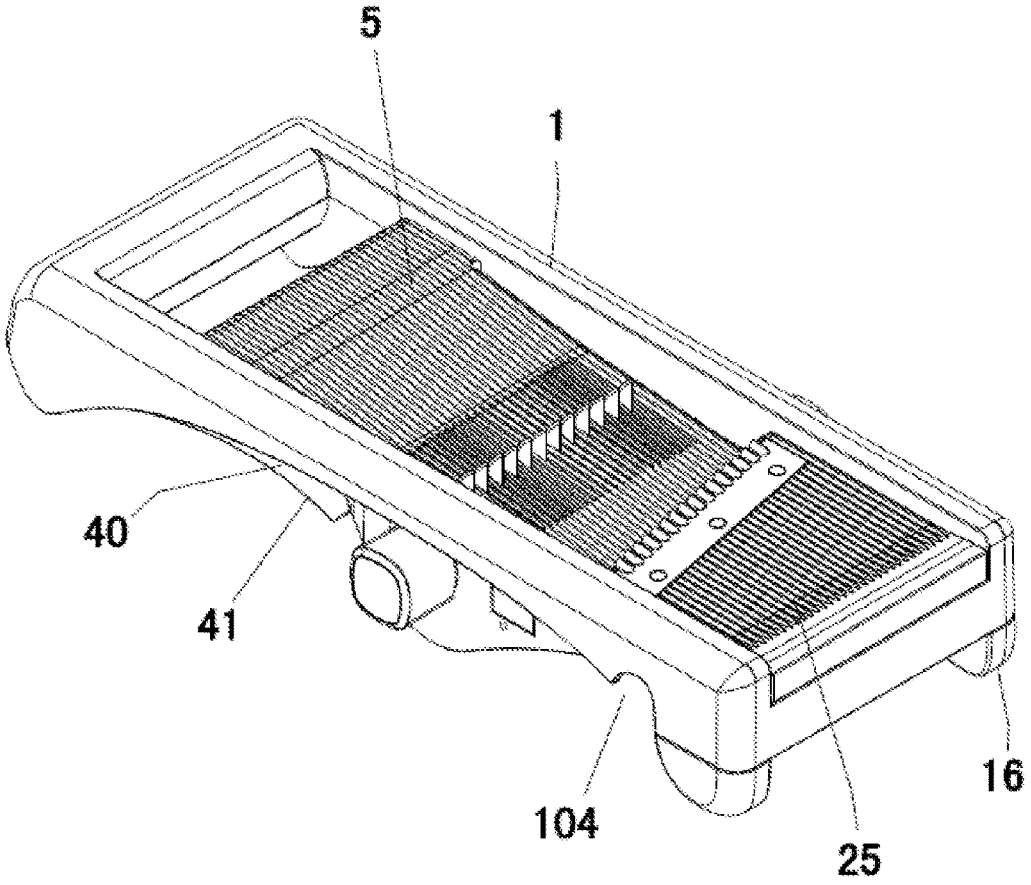
FIG. 6 is an alternative perspective view of FIG. 5.

In some embodiments, referring to FIG. 5 and FIG. 6, it is preferably that the side edge of the first pair of supporting structure 40 to be constructed as a curved-shaped structure so that even if the side edge 41 is projected outwardly from the bottom edge of the first supporting member 102 and when the first pair of supporting structure 40 is received under the body 5, the first pair of supporting structure 40 can also be a part of the apparatus which is in contact with the container. Both the curved-shaped design of the side edge 41 of the first pair of supporting structure 40 and the concave region 104 being arranged on the bottom edge of the first supporting members 102 can be used for allowing the base 1 to be placed on the container with different specifications.

Figure 7:
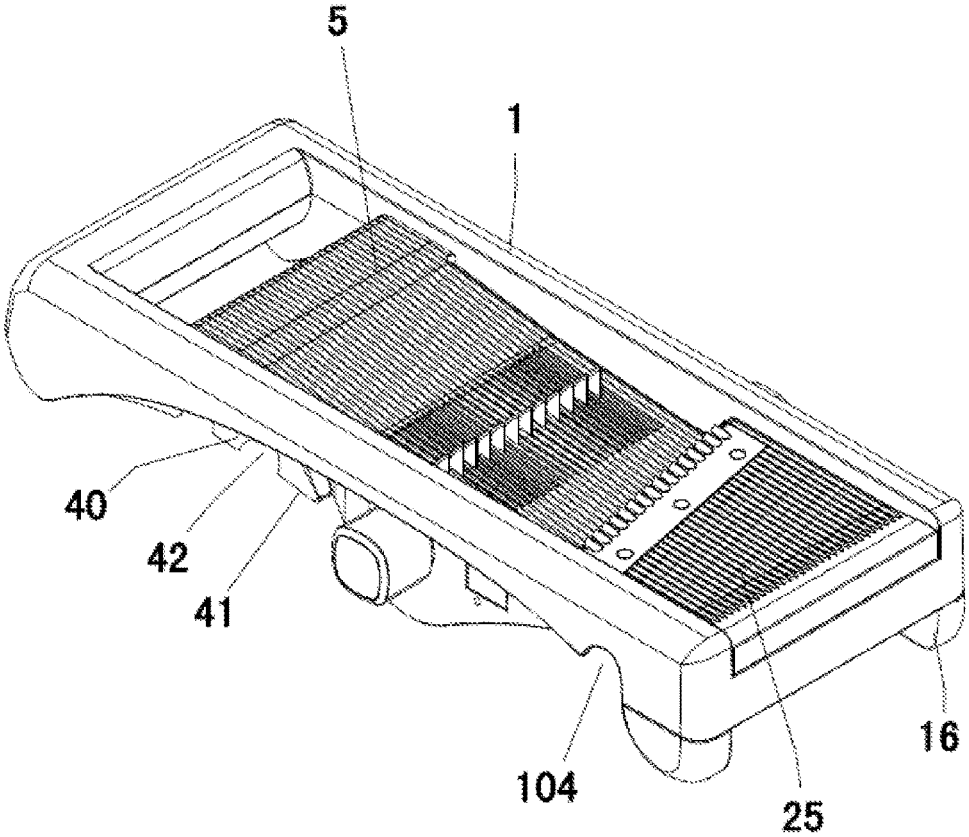
FIG. 7 is a perspective view of another embodiment of the present invention.
Figure 8:
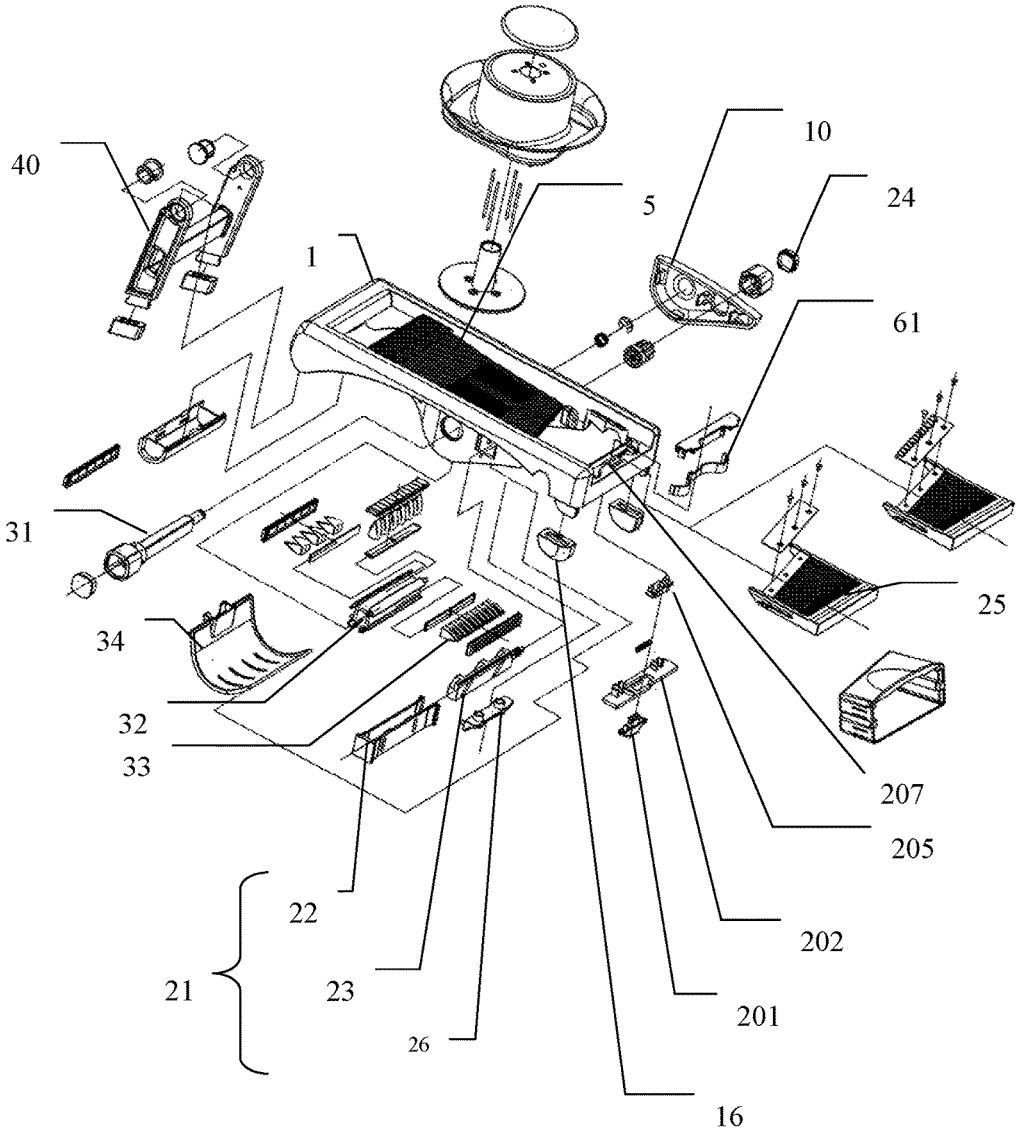
FIG. 8 is an exploded view of a second embodiment of the present invention.

Preferably, referring to FIG. 7 and FIG. 9, at least one concave region 42 is arranged on the side edge 41 of the first pair of supporting structures 40. In addition to the feature that the part of contacting with the container can be formed from the curved-shaped portion of the side edge 41 of the first pair of supporting structure 40, the implement of the present invention by constructing the concave portion 42 of the side edge 41 of the first pair of supporting structure 40 and the concave region 104 of the bottom edge of the first pair of supporting member 102 can allow the apparatus to mount on edges of the container more firmly, The above parts can be dismounted and removably mounted such that the difficulties in cleaning existed in the food cutting apparatus of the existing technology can therefore be solved.

Compared with the food cutting apparatus of the existing technology and due to the reason that the bottom edge of the food cutting apparatus of the present invention is constructed as a curved-shaped structure, the base will then be more adaptive and can be received with different sizes and shapes of the container where it achieves the purposes of conveniently use.

The present invention has been described in detail, with reference to the preferred embodiment, in order to enable the reader to practice the invention without undue experimentation. However, a person having ordinary skill in the art will readily recognize that many of the previous disclosures may be varied or modified somewhat without departing from the spirit and scope of the invention. Accordingly, the intellectual property rights to this invention are defined only by the following claims.

I claim:

1. A food cutting apparatus comprising:

a base;

a body mounted to the base;

a cutting device mounted to said base; and a lifting means for moving said body vertically relative to said base, said lifting means comprises:

a driving member movably arranged between opposing walls of said base, said driving member comprising at least one inclined elongated hole, a body mounting member having at least one convex structure for mounting said driving member to said body, a mounting structure for receiving said driving member, at least one vertically elongated hole arranged on a side of said mounting structure for receiving said at least one convex structure of said body mounting member, wherein said at least one convex structure of the said body mounting member is to be received by the said at least one inclined elongated hole of said driving member so that the movement of said driving member moves said body vertically, and a positioning means for restricting the movement of said driving member, said positioning means comprises said at least one convex structure of said body mounting member that interacts with said at least one vertically elongated hole of said mounting structure.

2. The food cutting apparatus according to claim 1, wherein the apparatus further comprises a locking device adapted for removably mounting the cutting device to the base.

3. The food cutting apparatus according to claim 1, wherein the driving member further comprises a threaded end member.

4. The food cutting apparatus according to claim 2, wherein the locking device comprises an elastic member adapted for dismounting the cutting device from the base, a locking structure adapted for mounting the cutting device to the base and a track adapted for restricting the cutting device to be moved along an inner wall of the base.

5. The food cutting apparatus according to claim 4, wherein the locking structure comprises a trapezoidal structure, the trapezoidal structure comprises an inclined surface which is shaped to correspond with an inclined surface of a projection projected from a side of the cutting device.

6. The food cutting apparatus according to claim 1, wherein a spacing between the body and the cutting device being defined as a food escape region, the base comprises two opposing first supporting members and two opposing second support members, at least one concave region is arranged on a bottom side of the first supporting members, the bottom side of the first supporting members comprises a curved portion.

7. The food cutting apparatus according to claim 1, wherein two ends of a bottom side of a first supporting member of the base are of curved structures, at least one concave region is arranged on the curved structure of the first supporting member.

8. The food cutting apparatus according to claim 6, wherein the remaining region of the bottom side of the first supporting members other than the concave region of the first supporting members is of curved shape, first and second pairs of supporting structures are arranged under said two opposing second supporting members.

9. The food cutting apparatus according to claim 8, wherein said first pair of the supporting structures adapted for being received under the body are pivotally mounted to one of said two opposing second supporting members.

10. The food cutting apparatus according to claim 8, wherein side edges of the first and second pairs of supporting structures are of the positions within bottom edges of the first supporting members, said second pair of supporting structures is adapted to be rotatably mounted to a the other one of said two opposing second supporting members, said first pair of supporting structures has flat bottom bases, said second pair of supporting structures has curved bottom bases.

11. The food cutting apparatus according to claim 6, wherein a first pair of supporting structures arranged under one of said two opposing second supporting members having side edges with at least one concave region on said side edge.

12. The food cutting apparatus according to claim 3, wherein said lifting means further comprises a knob adapted to be screwed with said threaded end member of the driving member.

* * * * *